US005833430A

United States Patent [19]

Reynolds et al.

[11] Patent Number: 5,833,430

[45] Date of Patent: Nov. 10, 1998

[54] WALL RAISING APPARATUS

[75] Inventors: Douglas Bradley Reynolds, Markstay; Lewellyn Boyce Colbourne, Chelmsford, both of Canada

[73] Assignee: Douglas Reynolds, Markstay, Canada

[21] Appl. No.: 842,363

[22] Filed: Apr. 24, 1997

[30] Foreign Application Priority Data

Oct. 23, 1996 [CA] Canada ..... 2188630

[51] Int. Cl.[6] ..... E04G 21/14

[52] U.S. Cl. ..... 414/11; 52/DIG. 1; 52/749

[58] Field of Search ..... 414/11; 52/749, 52/DIG. 1; 212/257

[56] References Cited

U.S. PATENT DOCUMENTS

| | | | |
|---|---|---|---|
| 1,725,329 | 8/1929 | Blandford | 414/11 |
| 2,812,077 | 11/1957 | Proctor | 414/11 |
| 2,907,477 | 10/1959 | Coleman | 414/11 |
| 3,058,602 | 10/1962 | Kilman | 414/11 |
| 3,382,988 | 5/1968 | O'Reilly | 414/11 |
| 3,485,386 | 12/1969 | Miller | 214/1 |
| 4,150,755 | 4/1979 | Trott et al. | 414/11 |
| 4,531,720 | 7/1985 | Soder | 414/11 |
| 4,600,348 | 7/1986 | Pettit | 414/11 |
| 5,114,294 | 5/1992 | Attman | 414/11 |
| 5,224,808 | 7/1993 | Macris | 414/11 |
| 5,303,899 | 4/1994 | Palya | 252/334 |
| 5,322,403 | 6/1994 | Herde | 414/11 |
| 5,322,404 | 6/1994 | Keller | 414/11 |
| 5,368,429 | 11/1994 | Young | 414/11 |
| 5,700,123 | 12/1997 | Rokosh et al. | 414/11 |
| 5,704,755 | 1/1998 | Jesperson | 414/11 |

FOREIGN PATENT DOCUMENTS

| | | | |
|---|---|---|---|
| 1240736 | 6/1986 | U.S.S.R. | 414/11 |

*Primary Examiner*—Brian L. Johnson
*Assistant Examiner*—Douglas Hess
*Attorney, Agent, or Firm*—Anthony Asquith & Co.

[57] ABSTRACT

On construction sites, the apparatus provides a mast, and a cable-operated winch, for pivot-lifting horizontally-manufactured wall-frames to the vertical position. Upper and lower section of 2"×6" lumber form the length of the mast. Top and bottom mast-elements have hollow-box sockets, into which the lengths of lumber are telescoped, and a middle mast-element receives both upper and lower lumber sections. The middle mast-element carries a winch, the cable of which is hooked to the top rail of the wall-frame.

15 Claims, 6 Drawing Sheets

WALL RAISING APPARATUS

This invention relates to the construction of buildings, in which wood-frame walls are built flat on the floor, and are then raised (i.e pivot-raised) into the final vertical position. The apparatus is an aid for the operation of pivot-lifting the wood-frame wall.

BACKGROUND TO THE INVENTION

In building construction, it is a common technique to build a frame-wall flat on the floor, alongside the place where the wall is to be erected. When the frame is finished, the frame is positioned with what will be the foot of the wall against the foundation; the carpenter then assembles an appropriate number of colleagues, and the team of people proceed to lift what will be the top end of the wall, with their hands, and then "walk" the wall to the upright position. Then, a prop is brought in to hold the wall frame in position. Often, a stop or abutment is nailed to the foundation, to hold the foot of the wall in place during lifting.

In the larger sizes, a wood-frame wall is heavy. The lifting-pivoting operation is an awkward one, and is rather difficult for a single person to attempt on his own. On the other hand, the inefficiency of having to assemble a team of people is all too evident, and carpenters do try to raise the walls on their own. The number of wall-frames that are damaged accidentally during lifting is high, not to mention the accidental injuries to persons that occur every year.

The apparatus of the invention is aimed at simplifying the task of raising the frame-wall, enabling the task to be carried out by the carpenter on his own, and without danger to himself, and without risk of damage to the wall.

Generally, it is desired that the portion or section of the wall of the building that is to be constructed on the ground should be as large as possible. The larger the sections in which the wall is built, the fewer the number of raising operations. One of the problems with larger sections is that each section becomes very unwieldy, and prone to twisting damage as it is raised. The apparatus of the invention is aimed at applying the lifting loads to the wall in a controlled and well-supported manner, whereby the sections can be large.

It is another aim of the invention to provide a wall-lifting apparatus which is so economical to manufacture as to be available to any carpenter. Indeed, the apparatus is inexpensive enough that any carpenter may possess two or more; then, the several apparatuses can be used in parallel with each other, on the same section of wall, whereby the sections of wall may be even larger.

THE PRIOR ART

U.S. Pat. No. 3,485,386 (Miller, July 1968) shows a mast-and-winch type of apparatus for raising walls, of the kind with which the invention is concerned.

U.S. Pat. No. 5,322,404 (Keller, June 1994) shows another apparatus for raising walls.

GENERAL FEATURES OF THE INVENTION

The invention is aimed at making it possible for the main length or height of the lifting mast of the apparatus to be made from a length or lengths of inexpensive elongate material, such as, especially, the lengths of lumber which are present in profusion at the building site where the just-manufactured wall is to be lifted. The prior-purchased apparatus includes mast-elements, the structures of which are designed to receive the lumber, and, when the lumber has been assembled to the elements, the lifting apparatus is then complete and ready for operation—all the operational aspects such as the safety of persons, the ease of operation by one person, the fast, forceful lifting, the ease of assembly/disassembly, the portability, etc, being provided by the design of the elements and the manner of interaction of the lumber with the elements.

With the invention, the only construction operation needed on-site to make the mast apparatus ready for a lift is to cut the pieces of lumber to the correct length. Each element in the mast-set is formed with a respective receptacle or socket, which is structurally suitable for receiving an elongate mast-member, preferably lengths of lumber.

BRIEF DESCRIPTION OF PREFERRED EMBODIMENTS

By way of further explanation of the invention, exemplary embodiments of the invention will now be described with reference to the accompanying drawings, in which.

DETAILED DESCRIPTION OF THE PREFERRED EMBODIMENTS

Figure 1:
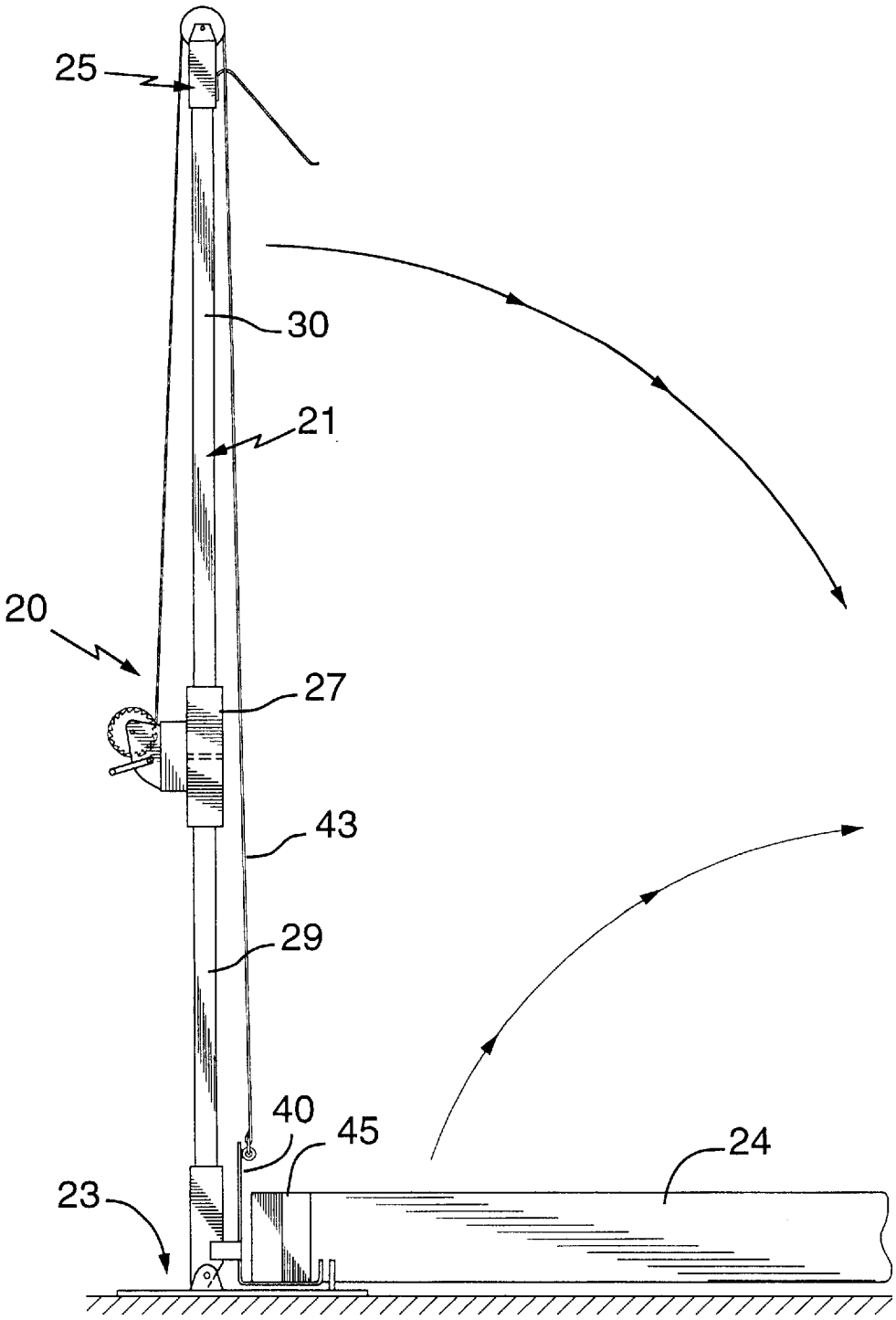
FIG. 1 is a side elevation of a wall-lifting apparatus that embodies the invention, shown with the apparatus being made ready for a wall-lifting operation.

The apparatuses shown in the accompanying drawings and described below are examples which embody the invention. It should be noted that the scope of the invention is defined by the accompanying claims, and not necessarily by specific features of exemplary embodiments.

The wall-lifting apparatus 20 shown in the drawings comprises: a mast 21, comprising a set of three mast elements and two elongate mast components; and a lifting cable, with a fitting for attaching the cable to the wall frame 24.

The three mast elements are the base element 23; the top element or pulley element 25; and the middle element or winch element 27. Each of these elements is formed with a rectangular hollow receptacle or box, the shape and size of the box being designed to allow a standard section of lumber to be inserted therein. It is convenient if the standard section of lumber the box is designed to accommodate could be the same size as the lumber from which the wall is being built. Wood-frame walls of the type that are lifted into place after being prepared flat on the floor are generally made of 2"×6" lumber, so preferably the box should be designed to receive that same section.

When purchasing the apparatus of the invention, the carpenter would purchase only the elements, and not the lumber components. One of the features of the invention is that the two components 29,30 of the mast can be made on-site from pieces of lumber that are inevitably ready to hand. Equally, when the lifting task has been completed, the apparatus can be easily dismantled and stowed away. The lengths 29,30 of lumber can be discarded. For the next lifting job, all the carpenter need do is cut two fresh pieces of lumber to length.

The designer of the apparatus may provide that the lower 29 of the two mast-components is always the same length. The length of the upper component 30 has to be tailored to the height of the wall, and wood-frame walls do vary in height. For the carpenter's convenience, one of the elements of the apparatus, for example the winch element 27, may be imprinted with a table showing the length to which the upper component of the mast should be cut, for the various standard heights of wall.

The carpenter might wish to keep the lower length 29 of lumber, and carry it around with him. Conveniently, the winch should be at hip or waist height, i.e about 1 meter off the ground, whereby the length 29 is not too inconvenient to be carried around. As to the upper component 30, however, for a wall height of 3 meters, for example, the overall height of the mast is about 4.3 meters, and the length of the top component is at least 3 meters. Now, a length like that is most inconvenient for the carpenter to carry around.

Conveniently, the length of the bottom mast component 29 may be cut so that the required length of the upper component 30 is roughly (or exactly) the same as the length of one of the uprights of the wall, so there is bound to be suitable length readily available.

When moving from job site to job site, the carpenter has to carry his tools and equipment with him, and compactness of the equipment is a major consideration. (Lightness of weight also, although compactness is major.) Having to carry around a long boom or mast would be a major difficulty —bearing in mind that the length of the mast has to be considerably longer than the height of the wall. Also, the apparatus is only used for a short time, and for the rest of the time the apparatus is on stand-by and is, in effect, in the way, so it can be expected that the apparatus will be treated roughly. Therefore, robustness of the apparatus is a key factor—and from this standpoint, again, the carpenter would find it most unsatisfactory if the apparatus, while on stand-by, included the mast.

Figure 3:
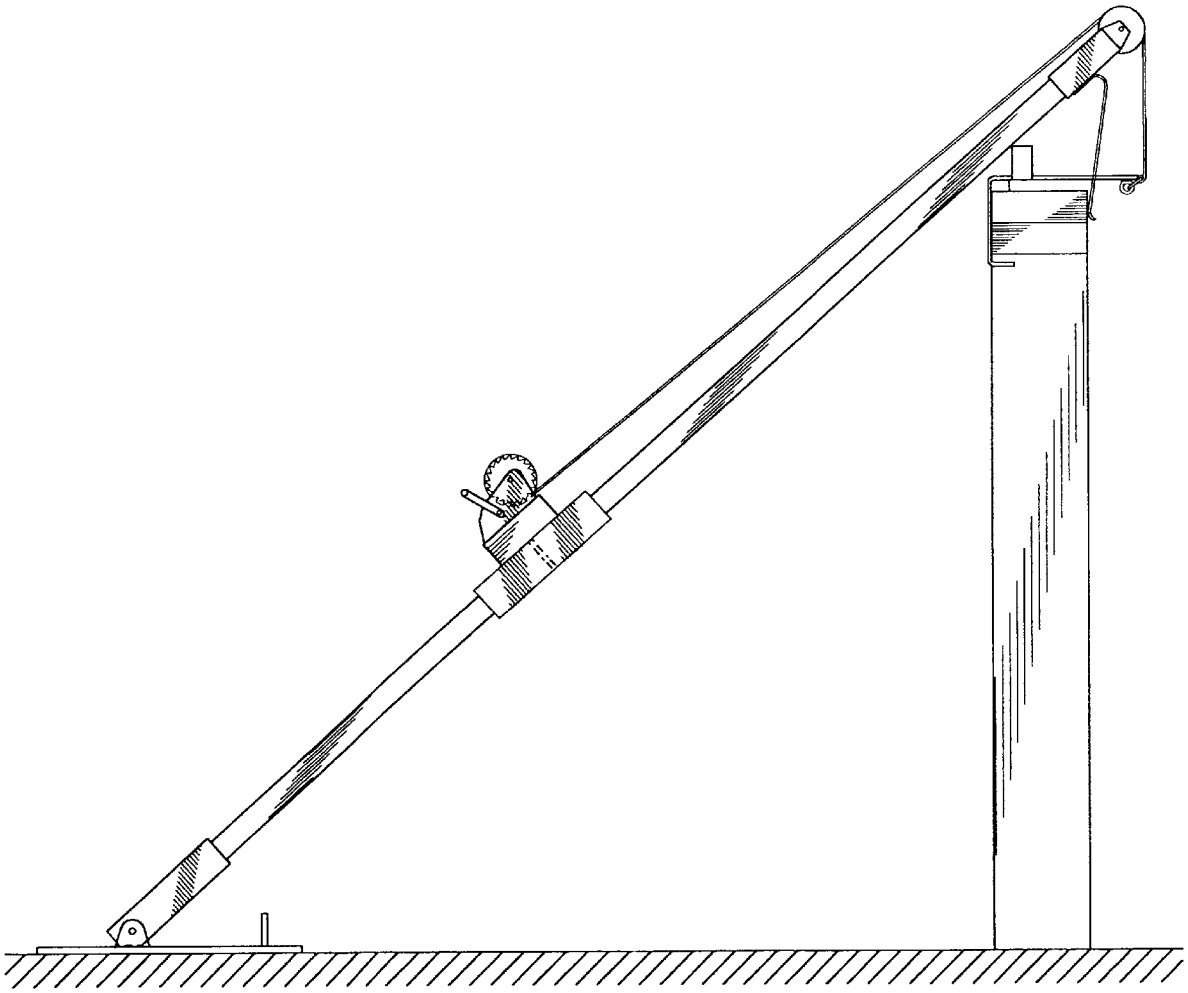
FIG. 3 is the same side elevation as FIG. 1, shown at a final point in the lifting operation.
Figure 4:
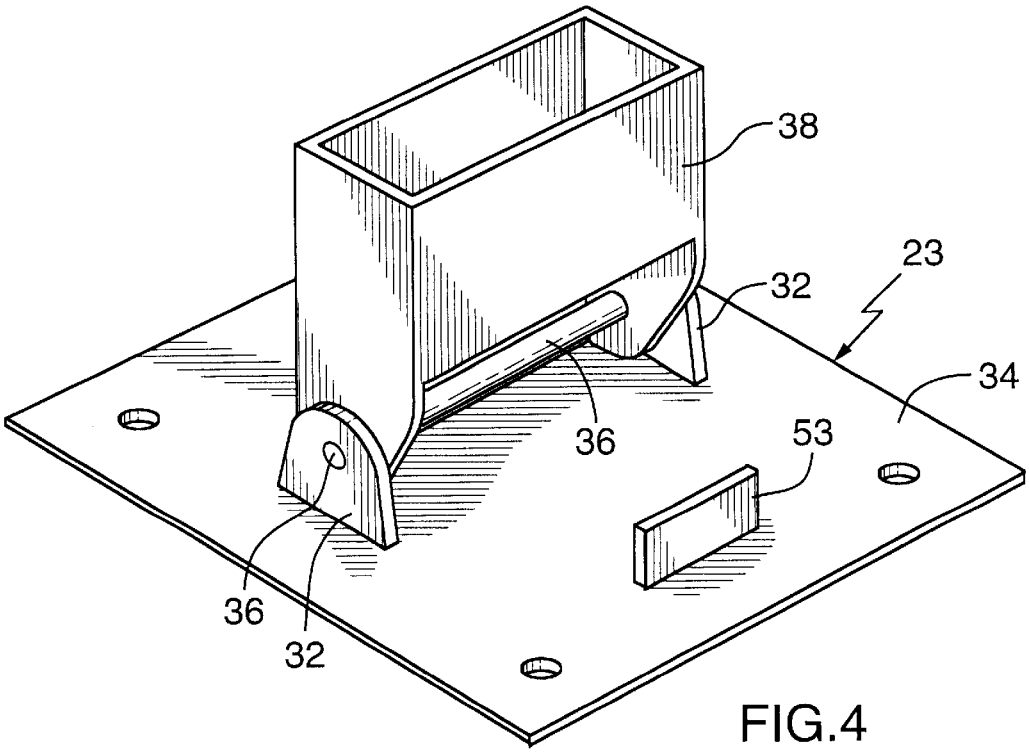
FIG. 4 is a pictorial view of a base-element of the apparatus of FIG. 1.

The base element 23 is shown in FIG. 4. Trunnions 32 on the base-plate 34 support a spindle 36, and the bottom receptacle or box 38 is mounted for pivoting about the spindle. The box 38 is shaped so as to receive a length of 2"×6" lumber, which telescopes into the box. The range of pivoting movement of the box 38 is such that the engagement of the box with the base plate restrains the whole mast from tipping any further back than is shown in FIG. 1, although a little lean-back may be provided from the nominal upright position, for stability during setting up. The box can pivot forwards to the 45 degree position as shown in FIG. 3. The base-plate 34 has holes, whereby the base plate may be (temporarily) nailed to the floor during lifting, if desired.

Figure 5:
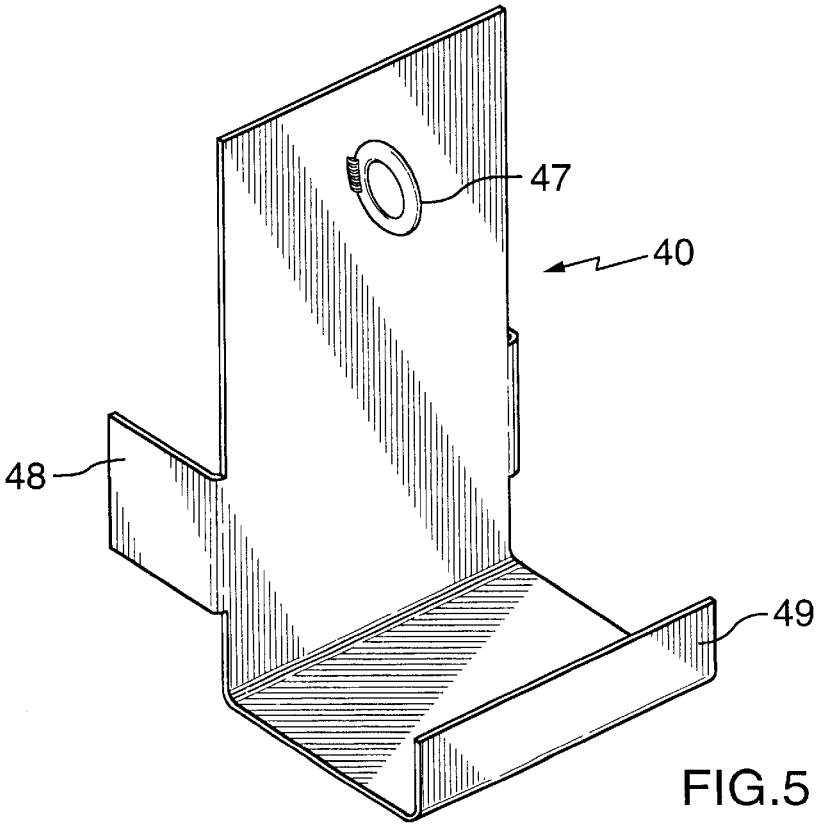
FIG. 5 is a pictorial view of an L-shaped fitting of the apparatus of FIG. 1.

The L-shaped hook-fitting 40 (FIG. 5) is for attaching the cable 43 to the top-rail 45 of the wall-frame 24. The fitting 40 receives the cable in the ring 47. Wing-tabs 48 on the fitting 40 constrain the fitting laterally with respect to the mast 21 as the fitting rises up the mast. The toe-lug 49 ensures that the fitting 40 remains safely in the correct operational position relative to the top rail 45 throughout lifting.

At the start of lifting, the carpenter must raise the top rail 45 slightly, and then slide the base plate 34 and the hook-fitting 40 underneath the top rail, as shown in FIG. 1. A toe-tab 53 on the base-plate 34 assists in locating the base-plate and the fitting 40 correctly in relation to the top rail 45.

Figure 6:
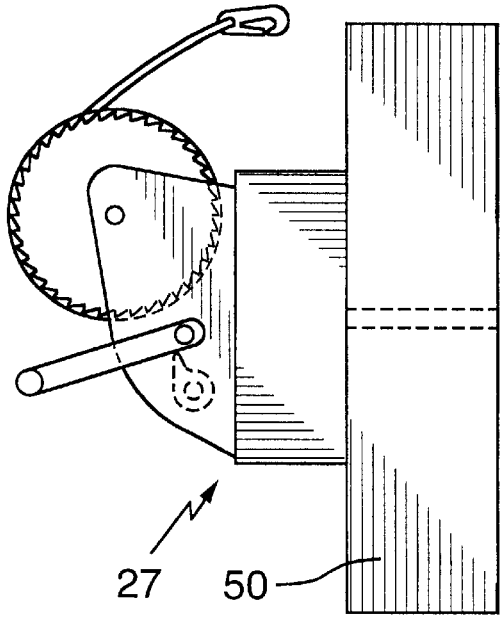
FIG. 6 is a side elevation of a winch-element of the apparatus of FIG. 1.
Figure 7:
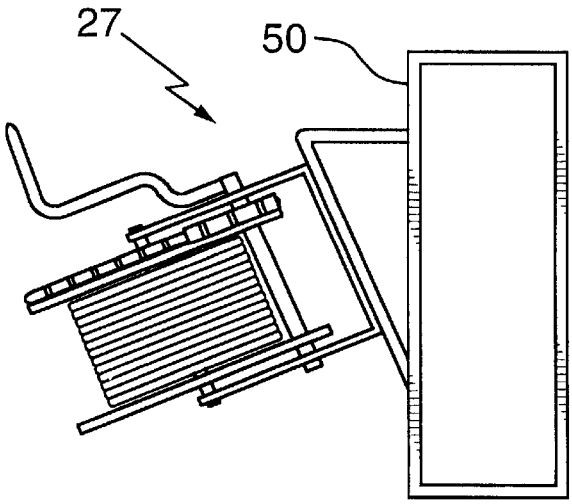
FIG. 7 is a plan view of the winch-element.

The winch element 27 is shown in FIGS. 6 and 7. The winch-element 27 includes a receptacle or box 50, which again is suitable for receiving the 2"×6" lumber. In fact, the box 50 receives both upper and lower lengths of lumber, and a stop is provided midway along the box to locate the box relative to the lengths. The winch 52 is mounted offset, as shown, to ensure good clearance for the winch operating handle.

Figure 8:
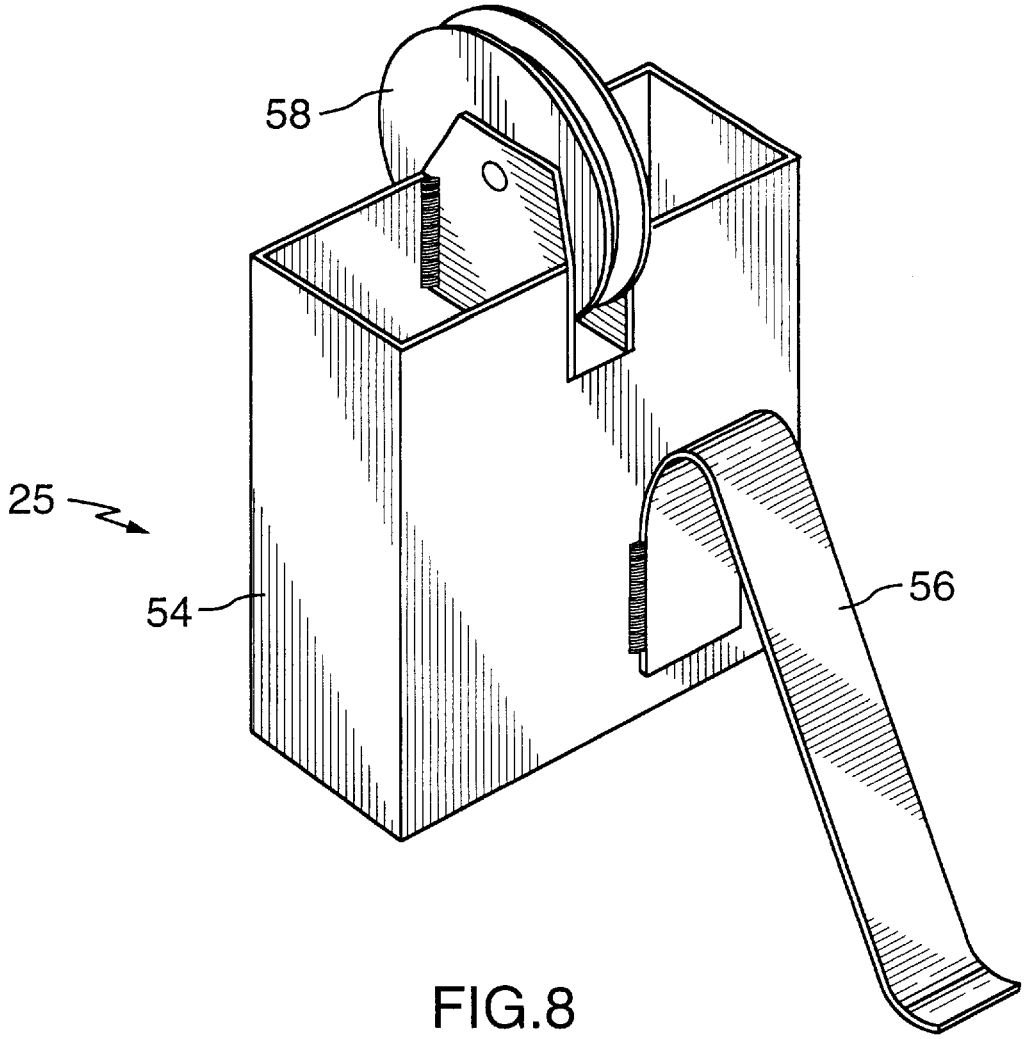
FIG. 8 is a pictorial view of a pulley-element of the apparatus of FIG. 1.

The pulley-element 25 (FIG. 8) includes a pulley-box 54, which again is suitable for receiving the 2"×6" lumber. The element 25 includes a restraint 56, which is welded to the box 54. It may be noted that the restraint 56 lies to one side of the pulley 58. So that the restraint 56 does not interfere with the run of the cable 43.

The boxes on the elements are so arranged that the lengths of lumber will remain in the boxes, by the action of gravity, and of cable tension, during a lifting operation. However, in case for example the wall should be caught by the wind during or after raising, for security the lumber preferably should be nailed into the boxes. Nail-holes may be provided in the boxes for the nails. Only one nail per box is needed, and that can be easily removed later.

Figure 2:
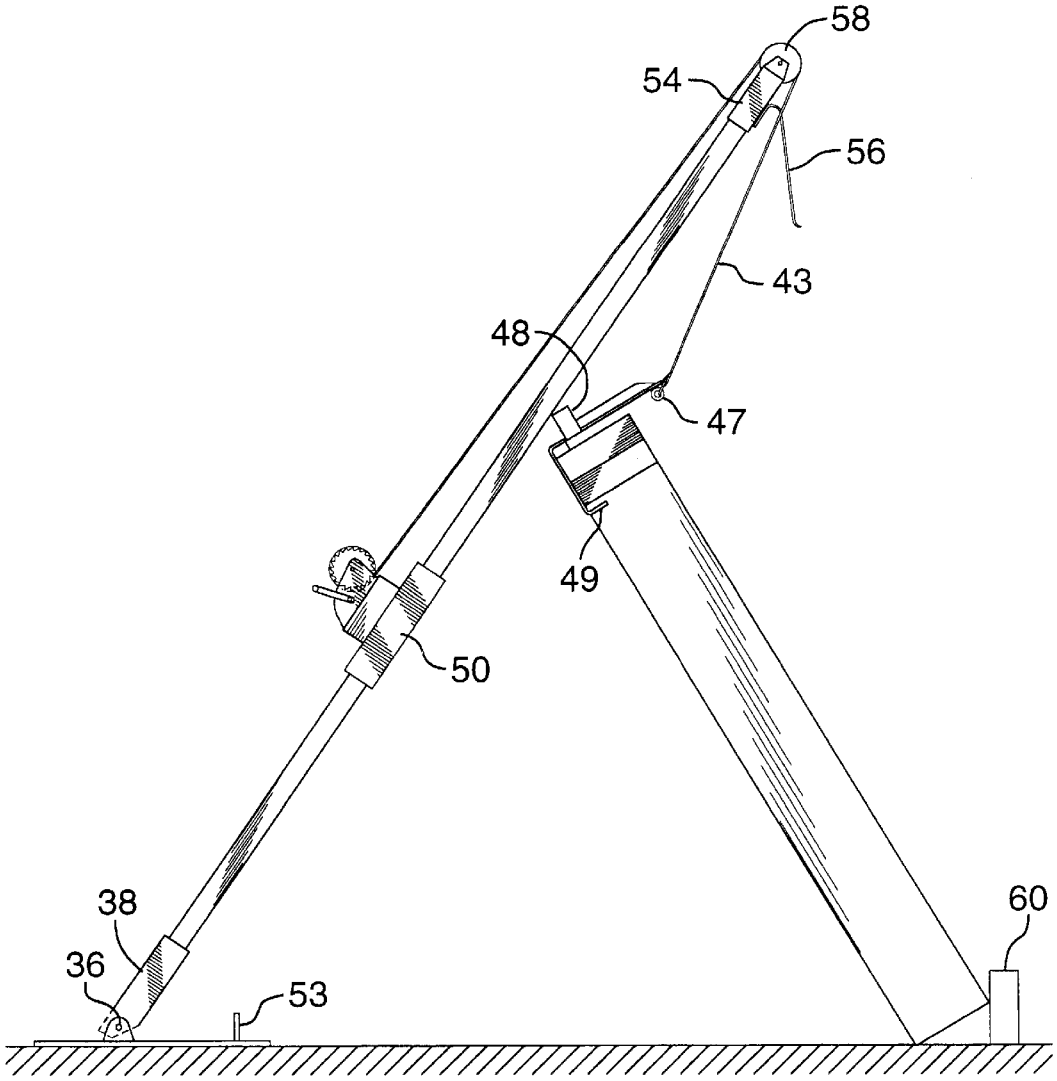
FIG. 2 is the same side elevation as FIG. 1, shown at an intermediate point in the lifting operation.

In operation, the mast 21 is first assembled to the FIG. 1 condition. A safety-conscious carpenter will then carry out a check to ensure the various components are all properly in their correct positions, prior to lifting. The carpenter may care to provide a stop 60 (FIG. 2), to ensure the wall-frame 24 will not slip during lifting. Alternatively, a common practice is to drive nails at an angle through the bottom of the wall and into the floor; when the wall is lifted the nails simply bend.

As lifting commences, the mast starts to lean forwards, resting against the hook-fitting 40, and the frame 24. The carpenter may continue with lifting, the operation requiring nothing by way of heavy exertion, or manual control of loads, whereby all his attention can be directed to the operation itself, making sure there is no snagging and that safety concerns are being addressed. The winch ratchet being engaged, he may discontinue lifting, with the wall frame in the partially-raised condition (FIG. 2), in order to inspect the progress of the lift. (Of course, he should not leave the apparatus unattended, while the wall is in the partially-lifted condition.)

As the wall-frame 24 nears the vertical position, there comes a point at which the wall starts to topple forwards of its own accord, and the cable goes slack. The restraint 56 is provided to accommodate this occurrence. The restraint is springy, and serves to gently gather in the top rail as the top rail falls forwards. The overall length of the mast is calculated so that, when the wall-frame 24 stands vertically, the mast lies at 45-degrees, and the top rail lies tucked into the crook between the restraint 56 and the upper component 30 of the mast.

Once the wall is vertical, the wall may be nailed or otherwise secured in position. Props may be needed to hold the wall in place while the rest of the building is assembled. The mast apparatus may then be removed. (It may be necessary for the carpenter to climb a ladder to release the cable from the ring 49, and to retrieve the L-shaped fitting 40.)

Alternatively, the mast apparatus itself may be used as the prop, if not required elsewhere. In this regard, it may be noted that the apparatus is a very secure prop, especially if the base plate 34 is nailed to the floor; also, the security of the mast as a prop is present even if the cable should be slack.

We claim:

1. Apparatus for pivot-lifting a wall-frame from a horizontal to a vertical position relative to a floor, wherein:

the apparatus includes a cable, and includes a hook means for attaching the cable to a top rail of the wall-frame;

the apparatus includes upper and lower elongate mast-members;

the apparatus includes a mast-set of elements;

the mast-set of elements comprises a top element, a winch element, and a base element;

the top-element of the mast-set includes a cable guide means which is so structured as to be effective, when the elements are assembled into a mast, to guide the cable over the top of the mast;

the winch-element of the mast-set includes an operable winch, which is so structured as to be suitable, when the elements are assembled into a mast, for being operated to apply force to the cable;

the base-element of the mast-set includes a base plate, which is suitable for resting on the floor, and includes a pivoting member, which is mounted on a pivot in the base plate;

the upper mast-member comprises a length of rectangular, uniform-cross-section, lumber;

the top-element is formed with a respective upper-member-socket, which has a cross-section that is complementary to the cross-section of the upper-mast-member, and which is so structured, in relation to the upper mast-member, that the upper mast-member can be readily engaged and assembled thereto for use of the apparatus, and can be readily disengaged and dismantled therefrom after use;

the winch-element is formed with a respective upper-member-socket, which has a cross-section that is complementary to the cross-section of the upper mast-member, and which is so structured, in relation to the upper mast-member, that the upper mast-member can be readily engaged and assembled thereto for use of the apparatus, and can be readily disengaged and dismantled therefrom after use.

2. Apparatus of claim 1, wherein the lower mast-member comprises a length of rectangular, uniform-cross-section, lumber;

the winch-element is also formed with a respective lower-member-socket, which has a cross-section that is complementary to the cross-section of the lower mast-member, and which is so structured, in relation to the lower mast-member, that the lower mast-member can be readily engaged and assembled thereto for use of the apparatus, and can be readily disengaged and dismantled therefrom after use;

the base-element is formed with a respective lower-member-socket, which has a cross-section that is complementary to the cross-section of the lower mast-member, and which is so structured, in relation to the lower mast-member, that the lower mast-member can be readily engaged and assembled thereto for use of the apparatus, and can be readily disengaged and dismantled therefrom after use.

3. Apparatus of claim 2, wherein, wherein the lower mast-member and the upper mast-member comprise two separate lengths of lumber.

4. Apparatus of claim 3, wherein the two separate lengths of lumber have the same cross-section.

5. Apparatus of claim 4, wherein the lumber is of standard 2"×6" cross-section.

6. Apparatus of claim 2, wherein, with respect of each of the sockets, the socket is so structured that the respective length of lumber can be engaged thereto and disengaged therefrom telescopically.

7. Apparatus of claim 2, wherein the aforesaid receptacles each have the shape of a hollow box of complementary rectangular section, and the aforesaid lumber is receivable therein.

8. Apparatus of claim 7, wherein: the winch-member includes a single hollow-box-shaped socket, which is long, and open-ended;

the upper-member-socket and the lower-member-socket are comprised by the open ends thereof;

and the hollow-box-shaped-socket includes a stop at an intermediate location therein, for limiting the assembly of the upper and lower mast-members thereto.

9. Apparatus of claim 1, in combination with a wall-frame including upright studs and a top rail, wherein:

the hook means is structurally suitable for being hooked to the top rail when the wall-frame is lying on the floor;

the hook means includes a means for securely attaching the cable to the hook means, for lifting the top rail by the force in the cable;

the hook means is so structured as to remain securely hooked to the top rail while the wall-frame is being raised by the force in the cable.

10. Combination of claim 9, wherein the top element includes a restraint means, which is so located in the top element as to serve as a stop for catching the top rail of the wall-frame, and for preventing further forward movement of the top rail after the wall-frame has been raised to the vertical position.

11. Combination of claim 10, wherein the restraint means is springy.

12. Combination of claim 9, wherein the hook means includes an L-shaped plate, having a toe lug, the hook means being so shaped and dimensioned as to fit around the top rail.

13. Combination of claim 9, wherein the hook means has side wings, for guiding the hook means laterally relative to the mast during a lifting operation.

14. Combination of claim 9, wherein the base plate is provided with a stop-lug, and the hook means is sized to fit, when hooked around the top rail and resting on the base-plate prior to lifting, between the stop-lug and the pivoting member.

15. Apparatus of claim 1, wherein the lower-member-socket in the base-element is formed in the pivoting member, the structural arrangement of the pivot being such that the lower mast-member, when assembled in the socket of the base-element, can pivot at least 45 degrees.

* * * * *